US009637992B2

(12) United States Patent
Thomas et al.

(10) Patent No.: US 9,637,992 B2
(45) Date of Patent: May 2, 2017

(54) DOWNHOLE SPEAR HAVING MECHANICAL RELEASE MECHANISM FOR USE IN WELLBORES AND METHODS OF USING SAME

(71) Applicant: Baker Hughes Incorporated, Houston, TX (US)

(72) Inventors: Reena Thomas, Houston, TX (US); Steven G. Blair, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 557 days.

(21) Appl. No.: 13/957,049

(22) Filed: Aug. 1, 2013

(65) Prior Publication Data

US 2015/0034321 A1 Feb. 5, 2015

(51) Int. Cl.
*E21B 31/20* (2006.01)

(52) U.S. Cl.
CPC ..... *E21B 31/20* (2013.01)

(58) Field of Classification Search
None
See application file for complete search history.

(56) References Cited

U.S. PATENT DOCUMENTS

| | | | | |
|---|---|---|---|---|
| 589,607 A | | 9/1897 | Mills | |
| 718,066 A | | 1/1903 | McWilliams | |
| 759,416 A | | 5/1904 | Brandon | |
| 1,388,992 A | | 8/1921 | Dutton | |
| 1,474,886 A | | 11/1923 | Boyce | |
| 2,348,563 A | | 5/1944 | Otis | |
| 2,719,051 A | * | 9/1955 | Hankins, Jr. | E21B 31/20 294/86.17 |
| 2,806,534 A | | 9/1957 | Potts | |
| 3,108,637 A | * | 10/1963 | Lee | E21B 23/06 294/86.22 |
| 3,542,128 A | * | 11/1970 | Owen | E21B 23/06 166/123 |
| 3,566,965 A | | 3/1971 | Solum | |
| 3,741,601 A | | 6/1973 | Dudley | |

(Continued)

FOREIGN PATENT DOCUMENTS

| | | |
|---|---|---|
| EP | 1025337 B1 | 9/2003 |
| EP | 1502001 B1 | 9/2008 |

(Continued)

*Primary Examiner* — Caroline Butcher
(74) *Attorney, Agent, or Firm* — Parsons Behle & Latimer

(57) ABSTRACT

A downhole retrieval tool for engaging and retrieving an object from a wellbore includes a mandrel and a grapple having a contracted position and an expanded position. In the expanded position, the grapple engages the object for retrieval. The grapple is operably associated with an expansion member disposed on the mandrel to facilitate movement of the grapple between the contracted and expanded positions. The expansion member is releasably connected to the mandrel. In the event that the downhole tool and object, once secured to each other, are unable to be retrieved from the wellbore, the expansion member can be released from the mandrel which, in turn, causes the grapple to release from the object so that the downhole tool can be removed from the wellbore. A stored energy member facilitates movement of the grapple from the contracted position to the expanded position.

17 Claims, 3 Drawing Sheets

(56) References Cited

U.S. PATENT DOCUMENTS

| | | | | | |
|---|---|---|---|---|---|
| 4,093,294 | A | * | 6/1978 | Taylor | E21B 31/20 294/86.25 |
| 4,181,344 | A | * | 1/1980 | Gazda | E21B 23/00 166/125 |
| 4,254,983 | A | | 3/1981 | Harris | |
| 4,332,410 | A | | 6/1982 | Baker | |
| 4,616,721 | A | | 10/1986 | Furse | |
| 4,696,502 | A | * | 9/1987 | Desai | E21B 29/00 166/98 |
| 5,085,479 | A | * | 2/1992 | Taylor | E21B 31/20 294/86.17 |
| 5,123,489 | A | * | 6/1992 | Davis | E21B 29/00 166/377 |
| 5,242,201 | A | | 9/1993 | Beeman | |
| 6,457,519 | B1 | | 10/2002 | Buytaert | |
| 2007/0012449 | A1 | | 1/2007 | Cruickshank et al. | |
| 2008/0142229 | A1 | | 6/2008 | Brisco et al. | |
| 2008/0190616 | A1 | | 8/2008 | Watson | |

FOREIGN PATENT DOCUMENTS

| | | | |
|---|---|---|---|
| GB | 2146091 | A | 4/1985 |
| GB | 2155577 | A | 9/1985 |
| GB | 2178093 | A | 2/1987 |
| GB | 2242458 | A | 10/1991 |
| GB | 2283517 | A | 5/1995 |
| GB | 2287270 | A | 9/1995 |
| GB | 2303864 | A | 3/1997 |
| GB | 2349903 | B | 6/2003 |
| GB | 2349902 | B | 8/2003 |
| GB | 2426270 | A | 11/2006 |
| GB | 2440815 | A | 2/2008 |
| WO | WO 92/15767 | | 9/1992 |
| WO | WO 94/09246 | | 4/1994 |
| WO | WO 99/37877 | | 7/1999 |
| WO | WO 02/086279 | A1 | 10/2002 |
| WO | WO 03/027434 | A1 | 4/2003 |
| WO | WO 2004/018925 | A1 | 3/2004 |
| WO | WO 2007/014006 | A1 | 2/2007 |

* cited by examiner

DOWNHOLE SPEAR HAVING MECHANICAL RELEASE MECHANISM FOR USE IN WELLBORES AND METHODS OF USING SAME

BACKGROUND

1. Field of Invention

The invention is directed to downhole tools for retrieving an object disposed in oil and gas wells and, in particular, to an expandable spear or grapple for insertion into an opening in an object disposed in the wellbore that expands to engage the object.

2. Description of Art

It is common for objects, such as a segment of a pipe or packer, to be stuck or forcibly lodged within a wellbore. In order for these objects to be removed from the wellbore, various fishing tools have been developed for the purpose of latching onto and retrieving the object, referred to in the industry as the "fish," from the wellbore. One type of fishing tool is known as an overshot fishing tool because the tool is disposed over at least a portion of the object, or fish, disposed within the bore of the well. Such overshot fishing tools are generally known in the art. Other types of fishing tools that function by gripping the inside of the fish, e.g., the inner diameter of the fish. Regardless of type of fishing tool, after the fish is gripped by the fishing tool, the fishing tool and the fish are transported to the surface of the well.

SUMMARY OF INVENTION

Broadly, the downhole tools disclosed herein include a mandrel having a grapple that is movable relative to the mandrel between a fully expanded position and a fully contracted position. In certain embodiments, an inner wall surface of the grapple is in sliding engagement with an expansion member disposed on an outer wall surface of the mandrel. Movement of the grapple from the fully contracted position toward the fully expanded position in conjunction with the expansion member causes a portion of the grapple to expand radially outward to engage an inner wall surface of the object. In so doing, the grapple is engaged to the object such that retraction of the tool upward within the wellbore toward the wellbore surface transports the tool and the object out of the well.

In certain embodiments, the expansion member is operatively associated with a mechanical release mechanism that, when activated, causes the expansion member to move from a first position to a second position. In the second position, the expansion member is no longer operatively associated with the grapple resulting in the grapple moving toward the fully contracted position and, thus, releasing the object.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
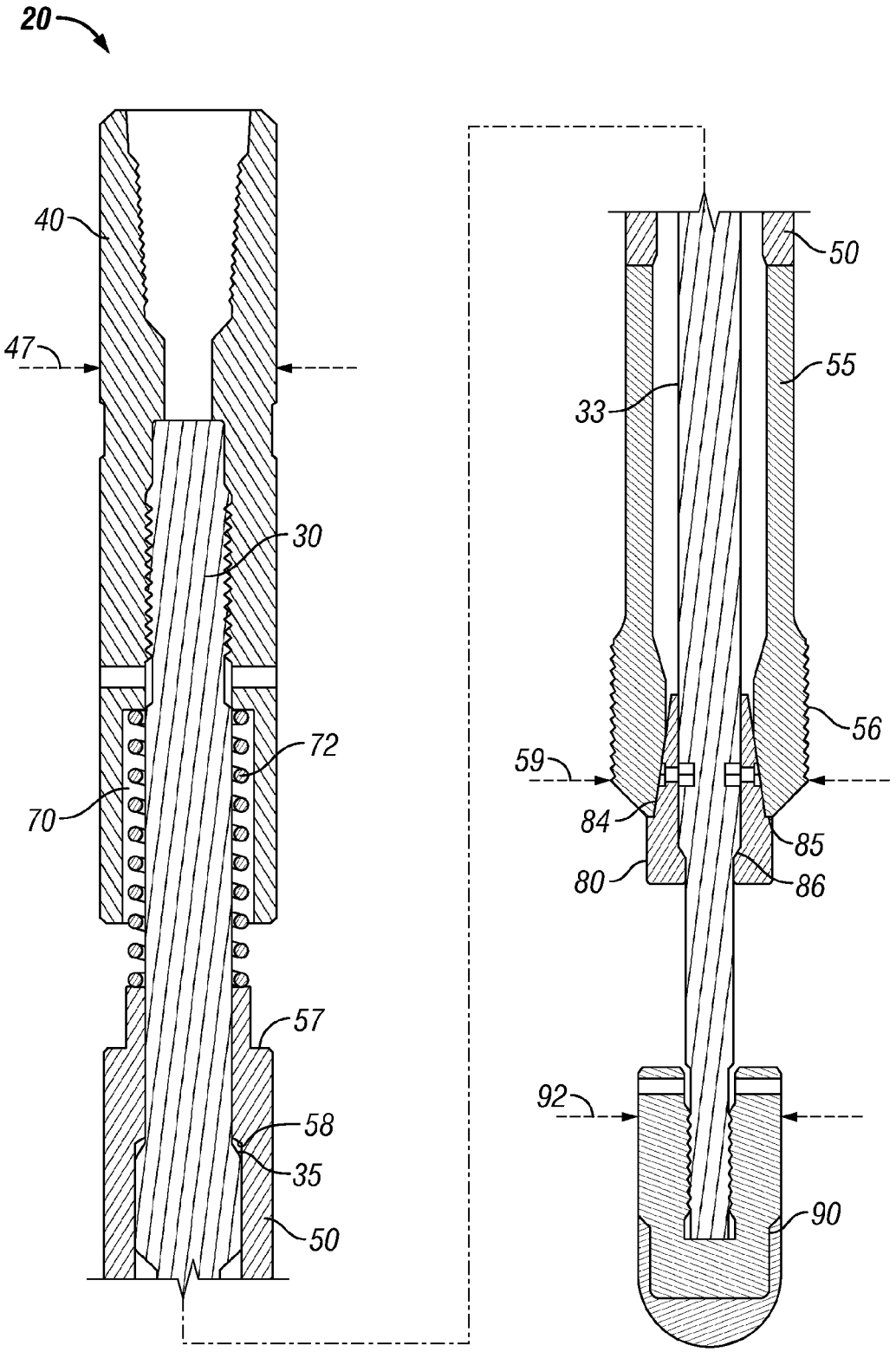
FIG. 1 is a cross-sectional view of one particular embodiment of the downhole tool disclosed herein shown with the slip member in the fully expanded position.
Figure 2:
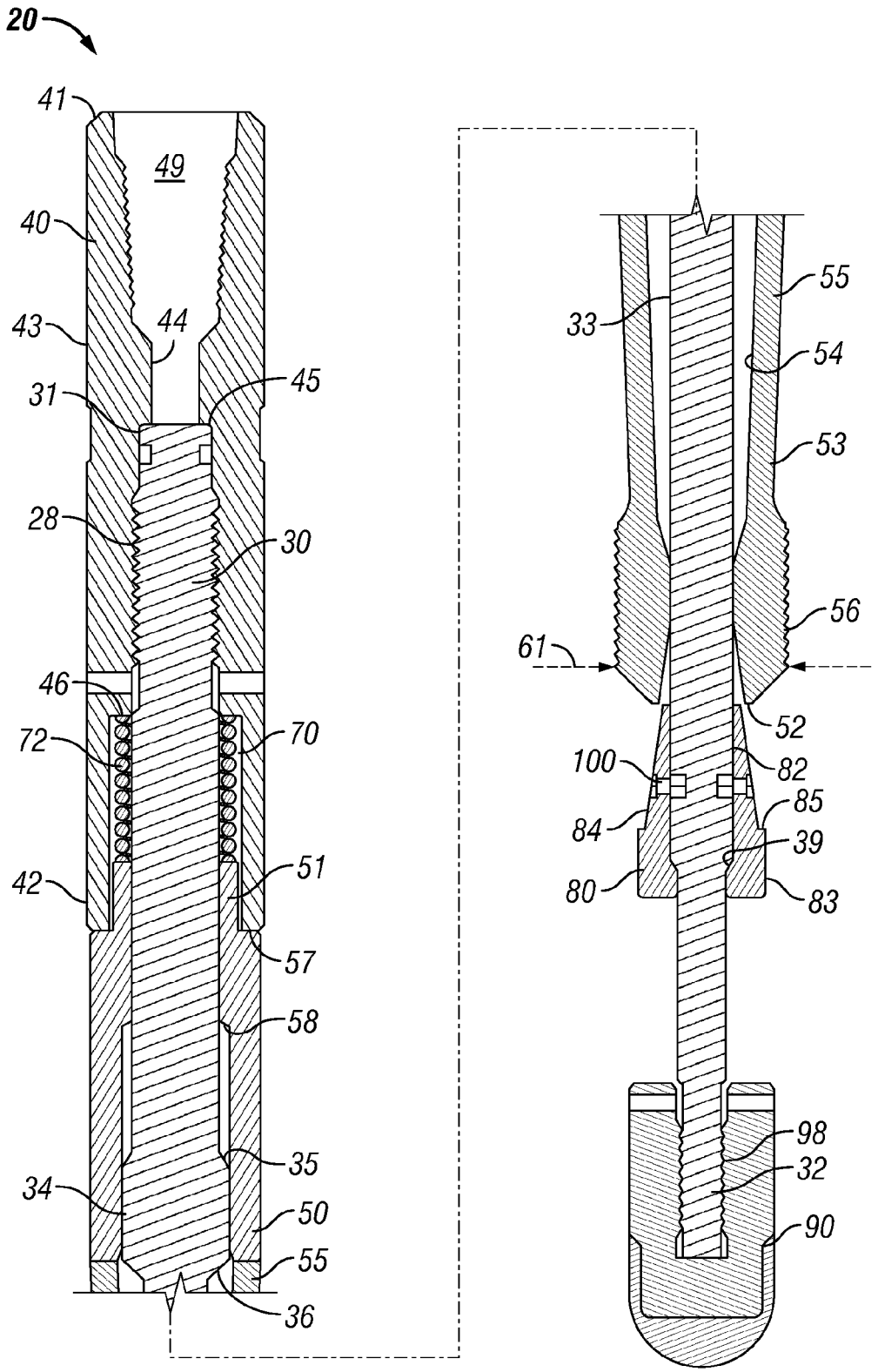
FIG. 2 is a cross-sectional view of the downhole tool of FIG. 1 shown with the slip member in the fully contracted position.
Figure 3:
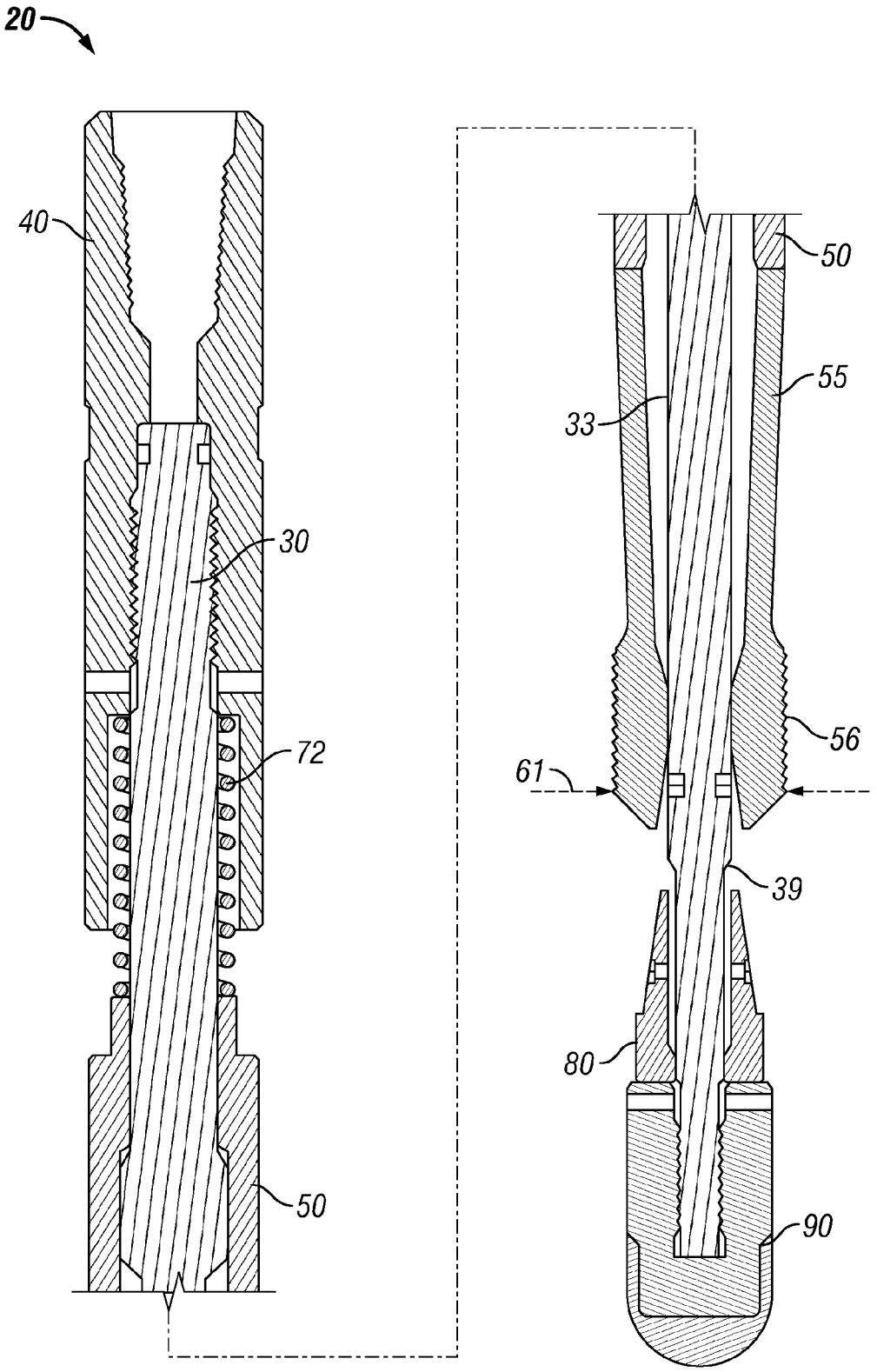
FIG. 3 is a cross-sectional view of the downhole tool of FIG. 1 having the expansion member disposed in its second or released position and the slip member in the fully contracted position.

Referring now to FIGS. 1-3, one specific embodiment of downhole tool 20 comprises mandrel 30 having first or upper end 31, second or lower end 32, and outer wall surface 33. Outer wall surface 33 includes flange 34 having upper flange shoulder 35 and lower flange shoulder 36. Outer wall surface 33 also includes expansion member shoulder 39 operatively associated with expansion member 80 discussed in greater detailed below.

Attached to upper end 31 of mandrel 30 is housing 40. Housing 40 comprises upper end 41, lower end 42, outer wall surface 43 defining outer diameter 47 (FIG. 1), and inner wall surface 44 defining bore 49. Disposed on inner wall surface 44 is upper shoulder 45 and lower shoulder 46. Housing 40 is attached to mandrel 30 through any device or method known in the art. As shown in the embodiment of FIGS. 1-3, housing 40 is releasably secured to mandrel 30 through threads 28.

Disposed in sliding engagement along outer wall surface 33 of mandrel 30 is a grapple assembly or slip member. In the embodiment illustrated in FIGS. 1-3, the slip member is a collet 50 having upper end 51, lower end 52, outer wall surface 53, inner wall surface 54, and one or more flexible fingers 55, each of which is biased inwardly toward mandrel 30. Disposed at a lower end of finger 55 is slip 56 having wickers and the like for engaging an object disposed within a wellbore. Outer wall surface 53 of collet 50 includes shoulder 57 and inner wall surface 54 of collet 50 includes shoulder 58.

Slips 56 each include a fully expanded position (FIG. 1) and a plurality of contracted positions. In the fully expanded position, slip 56 defines the maximum measurement of slip outer diameter, illustrated as diameter 59. Illustrated in FIG. 2 is the fully contracted position of slip 56 because the outer diameter defined by slip 56 is at its minimum measurement, illustrated as diameter 61. Other contracted positions are defined by how far slip 56 is moved radially outward from the fully contracted position, i.e. the minimum measurement of outer diameter 61, to the fully expanded position, i.e., maximum measure member of outer diameter 59.

As shown in the embodiment of FIGS. 1-3, shoulder 58 contacts or engages shoulder 35 of mandrel 30 when slip 56 is in the fully expanded position (FIG. 1).

A portion of each of outer wall surface 33 of mandrel 30, inner wall surface 44 of housing 40, lower shoulder 46 of housing, and upper end 51 of collet 50, partially defines chamber 70. Disposed within chamber 70 is a stored energy member such as coiled spring 72. As discussed in greater detail below, the stored energy member comprises a fully energized position and a plurality of released energy positions. In other words, stored energy member has a position in which the maximum amount of stored energy is retained in the stored energy member, and a plurality of released energy positions distinguishable from each other based on the amount of stored energy released. On such released energy position can exist where all of the store energy has been released from stored energy member.

Disposed below lower end 52 of collet 50 and operatively associated with slip 56 is expansion member 80. Expansion member 80 comprises inner wall surface 82 and outer wall surface 83. Outer wall surface 83 includes ramp 84, outer wall surface shoulder 85, and inner wall surface shoulder 86. Outer wall surface shoulder 85 engages slip 56 when slip 56 is in its fully expanded position (FIG. 1). Inner wall surface shoulder 86 engages expansion member shoulder 36 of mandrel 30 so as to restrict upward movement, i.e., movement toward housing 40, of expansion member 80.

Expansion member 80 is releasably secured to mandrel 30 through mechanical release member 100. Mechanical release member 100 is actuated through mechanical operation as opposed to hydraulic, pneumatic or other non-mechanical operation. In the embodiment of FIGS. 1-3, mechanical release member 100 comprises a shear component such as a shear screw that, upon application of sufficient force across the shear component, causes the shear component to fail. Actuation of the mechanical release member 100 in the embodiment of FIGS. 1-3, such as through application of sufficient force in an downward direction after slip 56 is engaged with expansion member 80 such that slip 56 is disposed in one or more of the plurality of other contracted positions, or the fully expanded position, as a result of slip 56 moving along ramp 84 causing slip 56 to be moved radially outward from the fully contracted position. After actuation of mechanical release member 100, expansion member 80 is free to slide along outer wall surface 33 of mandrel 30 from its first or secured position (FIGS. 1-2) to its second or released position (FIG. 3), i.e., downward along outer wall surface 33 of mandrel 30. Movement of expansion member 80 downward, out of engagement with slip 56, allows slip 56, which is biased inwardly, to move inwardly toward mandrel 30 and, thus, toward the fully contracted position (FIG. 3).

Attached to lower end 32 of mandrel 30 is guide 90 having guide outer diameter 92. In certain embodiments, guide 90 comprises a mill for boring into an object disposed within the wellbore. Guide 90 can be connected to mandrel 30 through any method or device known in the art. In the embodiment of FIGS. 1-3, guide 90 is releasably secured to lower end 32 of mandrel 30 through threads 98. In certain embodiments, guide outer diameter 92 is less than or equal to housing diameter 47. In addition, in certain embodiments, guide outer diameter 92 can be equal to, less than, or greater than, the minimum measurement of outer diameter 61 when slip 56 is in the fully contracted position.

In the fully expanded position (FIG. 1), slip 56 defines outer diameter 56 that is greater than outer diameter 47 of housing 40 and guide outer diameter 92. In the fully contracted position (FIGS. 2-3), slip 56 defines outer diameter 61 that is less than or equal to one or both of outer diameter 47 of housing 40 and guide outer diameter 92.

Further, in the fully expanded position (FIG. 1), the stored energy member has less stored energy as compared to when slip 56 is in the fully contracted position such that slips 56 are engaging or biting into an inner wall surface of the object (not shown) and the stored energy member is at its maximum energy level and is trying to release this stored energy (illustrated in FIG. 2). As a result, the stored energy member applies force to the slip 56 causing an increase in the friction or grip of slip 56 with the object disposed in the wellbore. In the embodiment of FIGS. 1-3, coiled spring 72 is shown fully energized in FIG. 2, and is shown as having fully released its stored energy in FIG. 1 (during engagement with the object) and FIG. 3 (after being released from the object).

In operation, downhole tool 20 is secured to a tubing or work string that is then lowered into a wellbore to a desired location where an object is located that is desired to be removed from the wellbore. During run-in (FIG. 1), slips 56 are disposed on ramp 84 and the stored energy member is de-energized. Upon encountering the object, downhole tool 20 is lowered into a bore or cavity of the object. Alternatively, the mill disposed at lower end 32 of mandrel 30 is activated to bore an opening into an object disposed in the wellbore.

At a point during the of insertion of downhole tool 20 into the bore or cavity of the object, slips 56 come into contact with an inner wall surface of the bore or cavity of the object such that continued downward movement of mandrel 30 and housing 40 into the bore or cavity of the object causes slips 56 to become engaged with the inner wall surface of the bore or cavity. As a result, slips 56 are moved from their fully expanded positions (FIG. 1) toward their fully contracted positions (FIG. 2). In so doing, outer diameter 59 of slips 56 decreases toward outer diameter 61 as slips 56 engage the object, and the stored energy member becomes more energized.

Downhole tool 20 is further inserted into the object until the bore in which downhole tool 20 is being inserted has an increase in size of the inner diameter. At this point during the insertion of downhole tool 20 into the bore of the object, the stored energy member releases some or all of its stored energy. As a result, slips 56 are moved toward the fully expanded position by sliding along ramp 84. In so doing, the wickers on slips 56 engage or bite into the inner wall surface of the bore of the object and the object can be retrieved from the wellbore as slips 56 are now disposed in a smaller inner diameter of the bore of the object as compared to when the slips 56 first enter into the bore of the object.

During the run-in of downhole tool, and engagement of slips 56 with the inner wall surfaces of the object, slips 56 are in "operable contact" with expansion member 80. As used herein, the term "operable contact" means that expansion member 80 is secured to mandrel 30 in the second or secured position (illustrated in FIGS. 1 and 2) such that slip 56 is capable of being expanded radially outward or contracted radially inward by expansion member 80. Expansion member 80 is out of operable contact with slip 56 when slip 56 is unable to move radially outward or inwardly through operation of expansion member 80 regardless of the position of slip 56.

In certain situations, the object is unable to be retrieved from the wellbore due to it getting stuck or encountering some other type of hindrance to its movement. In these circumstances, it is desirable to release downhole tool 20 from the object so that downhole tool 20 can be removed from the wellbore and another tool, such as a mill shoe or other cutting device, can be disposed into the wellbore to grind away the object. To facilitate releasing downhole tool 20 from the object, expansion member 80 can be releasable from mandrel 30. Because the engagement of slips 56 with the object is facilitated by disposing slips 56 on ramp 84 of expansion member 80, movement of expansion member 80 downward along outer wall surface 33 of mandrel will cause the stored energy member to release all stored energy and slips 56 to move toward their fully contracted positions (FIG. 3). To facilitate movement of expansion member 80 downward along outer wall surface 33 of mandrel 30, a downward axial force is applied to downhole tool 20. This downward axial force actuates the mechanical release member 100, such as by compromising, breaking or shearing the shear component or shear screw. As a result, expansion member 80 is no longer secured to mandrel 30 and it falls, due to gravity, downward to its second or released position. As expansion member 80 is no longer facilitating maintaining slips 56 in a position other than the fully contracted position, slips 56, which are biased inwardly, are moved to their fully contracted position and stored energy member releases some or all of its stored energy as illustrated in FIG. 3. After disengaging from the object, downhole tool 20 can be removed from the wellbore.

It is to be understood that the invention is not limited to the exact details of construction, operation, exact materials, or embodiments shown and described, as modifications and equivalents will be apparent to one skilled in the art. For example, the portion of the mandrel below the expansion member is not required to have a smaller outer diameter as compared to a portion of the mandrel disposed above the expansion member. In other words, the expansion member shoulder 39 on the outer wall surface 33 of the mandrel 30 and reciprocal inner wall surface shoulder 86 on inner wall surface 82 of expansion member 80 are not required. In addition, the stored energy member is not required to be a coiled spring, but instead can comprise a compressible elastomeric member, Bellville washers, and the like. Further, stored energy member is not required to be fully energized when the slips are in their fully expanded position. Likewise, stored energy member is not required to have released all of its stored energy when the slips are in the fully contracted position.

Further, it is to be understood that the term "wellbore" as used herein includes open-hole, cased, or any other type of wellbores. In addition, the use of the term "well" is to be understood to have the same meaning as "wellbore." Moreover, in all of the embodiments discussed herein, upward, toward the surface of the well (not shown), is toward the top of Figures, and downward or downhole (the direction going away from the surface of the well) is toward the bottom of the Figures. However, it is to be understood that the tools may have their positions rotated in either direction any number of degrees. Accordingly, the tools can be used in any number of orientations easily determinable and adaptable to persons of ordinary skill in the art. Accordingly, the invention is therefore to be limited only by the scope of the appended claims.

What is claimed is:

1. A downhole tool for engaging an object in a wellbore, the downhole tool comprising:

a mandrel having an upper end, a lower end, and an outer wall surface;

a slip member in sliding engagement with the outer wall surface of the mandrel, the slip member having a fully contracted position defining a fully contracted diameter, a fully expanded position defining a fully expanded diameter, and a plurality of contracted positions each having a respective variable contracted diameter, the fully expanded diameter being greater than the fully contracted diameter, and each of the variable contracted diameters being less than the fully expanded diameter and greater than the fully contracted diameter;

an expansion member disposed on the outer wall surface of the mandrel and operatively associated with the slip member to move the slip member between the fully contracted position and the fully expanded position; and a mechanical release member, the expansion member being mechanically releasably secured to the outer wall surface of the mandrel by the mechanical release member, the expansion member including a first position and a second position, the first position being in operable contact with the slip member to facilitate movement of the slip member between the fully contracted position and the fully expanded position, and the second position being out of operable contact with the slip member;

wherein the mechanical release member selectively secures the expansion member in the first position, wherein the mechanical release member inhibits movement of the expansion member upwards, downwards, and around the mandrel, and wherein the actuation of the mechanical release member permits the expansion member to slide along the mandrel from the first position to the second position.

2. The downhole tool of claim 1, wherein the outer wall surface of the mandrel includes an expansion member shoulder engaged with the expansion member when the expansion member is in the first position to prevent movement of the expansion member along the outer wall surface of the mandrel in a direction toward a housing.

3. The downhole tool of claim 2, further comprising a stored energy member operatively associated with the slip member wherein actuation of the stored energy member facilitates movement of the slip member from the fully contracted position toward the fully expanded position.

4. The downhole tool of claim 3, wherein the stored energy member comprises a coiled spring having an expanded position and a plurality of compressed positions, the coiled spring being in the expanded position when the slip is in the fully expanded position.

5. The downhole tool of claim 4, wherein the coiled spring is disposed within a chamber at least partially defined by the outer wall surface of the mandrel, an inner wall surface of the housing disposed over a portion of the mandrel, and an upper end of the slip member.

6. The downhole tool of claim 5, wherein the slip member comprises an inwardly biased collet having at least one collet finger.

7. The downhole tool of claim 6, wherein the inwardly biased collet comprises a plurality of collet fingers.

8. The downhole tool of claim 7, wherein the slip member comprises a shoulder disposed on an inner wall surface, and the outer wall surface of the mandrel comprises an upper shoulder, the shoulder on the inner wall surface of the slip member engaging the upper shoulder disposed on the outer wall surface of the mandrel when the slip member is disposed in the fully expanded position.

9. The downhole tool of claim 8, wherein the upper shoulder disposed on the outer wall surface of the mandrel is disposed on a flange member.

10. The downhole tool of claim 9 wherein the expansion member is releasably secured to the outer wall surface of the mandrel by a shear component.

11. The downhole tool of claim 1, wherein the slip member is biased toward the fully expanded position.

12. The downhole tool of claim 11, further comprising a stored energy member operatively associated with the slip member wherein actuation of the stored energy member facilitates movement of the slip member from the fully contracted position toward the fully expanded position.

13. The downhole tool of claim 12, wherein the stored energy member is disposed within a chamber at least partially defined by the outer wall surface of the mandrel, an inner wall surface of a housing disposed over a portion of the mandrel, and an upper end of the slip member.

14. The downhole tool of claim 13, wherein the slip member comprises an inwardly biased collet having a plurality of collet fingers.

15. A method of retrieving an object disposed in a wellbore, the method comprising the steps of:

(a) inserting a downhole retrieval tool into a bore of an object disposed in a wellbore;

(b) during step (a), moving a slip member of the downhole retrieval tool from an expanded position to a contracted position;

(c) moving the slip member from the contracted position toward the expanded position to engage the slip member with an inner wall surface of the object disposed within the wellbore;

(d) withdrawing the downhole retrieval tool and the object from the wellbore; and (e) mechanically releasing the slip member from the inner wall surface of the object by applying an axial force to the slip member, wherein the axial force is in a downward direction and is applied to an expansion member operatively associated with the slip member to facilitate movement of the slip member between the contracted position and the expanded position the expansion member being mechanically connected to a mandrel inhibiting upward, downward, and rotational movement of the expansion member along the mandrel, and wherein the axial force releases the expansion member from the mandrel of the downhole retrieval tool causing the expansion member to slide along the mandrel out of operable contact with the slip member so that the slip member moves toward a fully contracted position.

16. The method of claim 15, wherein during step (b), the downhole retrieval tool is being inserted through a first diameter of the bore of the object, and during step (c), the downhole retrieval tool is being inserted through a second diameter of the bore of the object, the second diameter being greater than the first diameter.

17. The method of claim 15, wherein during step (b), a stored energy member becomes energized, and during step (c), the stored energy member releases a least a portion of energy.

* * * * *